US008795047B2

(12) United States Patent
Tsai et al.

(10) Patent No.: US 8,795,047 B2
(45) Date of Patent: Aug. 5, 2014

(54) GAME MACHINE WITH POP-OUT LIGHTED TARGET

(71) Applicants: Chi-Ming Tsai, Changhua County (TW); I-Chiang Yang, Changhua County (TW)

(72) Inventors: Chi-Ming Tsai, Changhua County (TW); I-Chiang Yang, Changhua County (TW)

(73) Assignee: Feiloli Electronic Co., Ltd., Changhua County (TW)

( * ) Notice: Subject to any disclaimer, the term of this patent is extended or adjusted under 35 U.S.C. 154(b) by 131 days.

(21) Appl. No.: 13/645,146

(22) Filed: Oct. 4, 2012

(65) Prior Publication Data

US 2014/0100009 A1 Apr. 10, 2014

(51) Int. Cl.
*A63B 67/00* (2006.01)

(52) U.S. Cl.
USPC ..... 463/7; 273/446

(58) Field of Classification Search
IPC ..... A63B 67/00
See application file for complete search history.

(56) References Cited

U.S. PATENT DOCUMENTS

2001/0014622 A1* 8/2001 Hazama ..... 463/36
2009/0224481 A1* 9/2009 Mukasa et al. ..... 273/454

* cited by examiner

*Primary Examiner* — Omkar Deodhar

(57) ABSTRACT

A game machine includes a cabinet, a supporting rod disposed in the cabinet, a retaining base secured on top of the rod, a lighting device disposed on the retaining device, and a drive mechanism disposed in the cabinet. The rod defines a bore therein. The retaining base defines an aperture in communication with the bore in the rod. The lighting device has its electric wire extending through both of the aperture in the retaining base and the bore in the rod. The target is made of a light-transmissive material. The retaining base and the lighting device are housed in a receptacle of the target. The drive mechanism is configured to drive the rod to move up to have the target pop out of a hole in a table of the cabinet.

12 Claims, 6 Drawing Sheets

GAME MACHINE WITH POP-OUT LIGHTED TARGET

BACKGROUND OF THE INVENTION

1. Field of the Invention

The present invention relates to a target hitting game machine, such as a "whack-a-hole" machine, where a player gains points by using a mallet or a hammer to whack mechanical targets, such as moles, as they pop out of their holes, and in particularly to a target hitting game machine with targets which can be lighted up as they pop out.

2. Description of the Related Art

A conventional target hitting game machine, such as a whack-a-mole machine, consists of a large, waist-level cabinet with holes in its top and a large, soft mallet. Within each hole is a single mole or target driven by machinery necessary to move it up and down. Once the game starts, the moles will begin to pop up from their holes at random. The object of the game is to force the individual moles back into their holes by hitting them directly on the head with the mallet, thereby adding to the player's score. The score will be shown on a display which may be lighted to apply fancy visual effects for the score; however, the targets or moles are dim during the game.

FIG. 6 illustrates another type of conventional target hitting game machine 900 with targets 91 that can be lighted up. Once the game starts, the targets 91 will begin to be lighted at random. The object of the game is to hit the individual lighted targets 91 with a mallet 92, thereby adding to the player's score. However, the targets 91 always bulge outward from their sockets 93 in the table 90 and substantially stay in the same height level even when they get hit.

SUMMARY OF THE INVENTION

It is therefore a primary object of the subject invention to provide a game machine with targets that are hidden in their holes and will be lighted up when they pop-out.

To fulfill that object, the game machine includes a cabinet, a supporting rod disposed in the cabinet, a retaining base secured on top of the rod, a lighting device disposed on the retaining base, at least one target on top of the rod, and a drive mechanism disposed in the cabinet.

Specifically, the cabinet has a table in which at least one hole is defined. The rod is formed on top with a flattop head, and defines a first bore therein. The retaining base is secured on top of the head of the rod, and defines an aperture in communication with the first bore in the rod. The lighting device has a light source and an electric wire extending from the light source. The light source is seated on the retaining base; and the electric wire extends through both of the aperture in the retaining base and the first bore in the rod. The target is made of a light-transmissive material and has a receptacle such that the retaining base together with the lighting device is housed in the receptacle of the target. The drive mechanism is configured to drive the rod to move up and down. When the rod moves up, the target on the rod pops out of the hole in the table of the cabinet and the lighting device inside the transparent target can be turned on to provide fancy visual effects. In contrast, when the rod moves down, the target retracts back into the hole and the lighting device may be turned off.

Further benefits and advantages of the present invention will become apparent after a careful reading of the detailed description with appropriate reference to the accompanying drawings.

BRIEF DESCRIPTION OF THE DRAWINGS

A game machine according to the invention will now be described, by way of example, with reference to the accompanying drawings, in which.

DETAILED DESCRIPTION OF PREFERRED EMBODIMENT

The present invention will hereinafter be explained with reference to the preferred embodiment illustrated in FIGS. 1-5.

Figure 1:
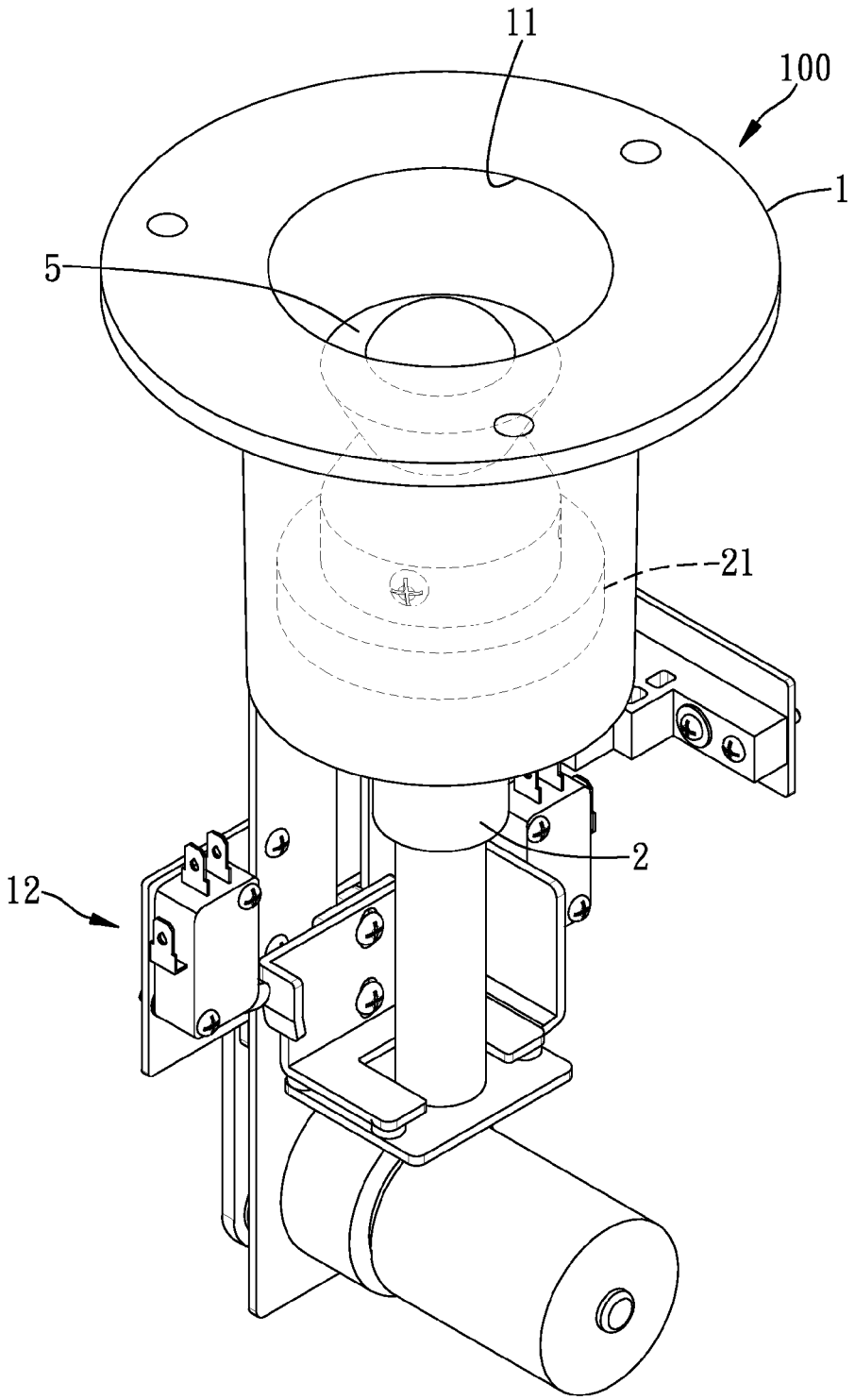
FIG. 1 is a fragmentary isometric view of the game machine.

Referring to FIG. 1, a target-hitting game machine 100 includes a cabinet (not shown) with a table 1 in which at least one hole 11 is defined. Inside the cabinet are a drive mechanism 12 and at least one target assembly 5.

Figure 2:
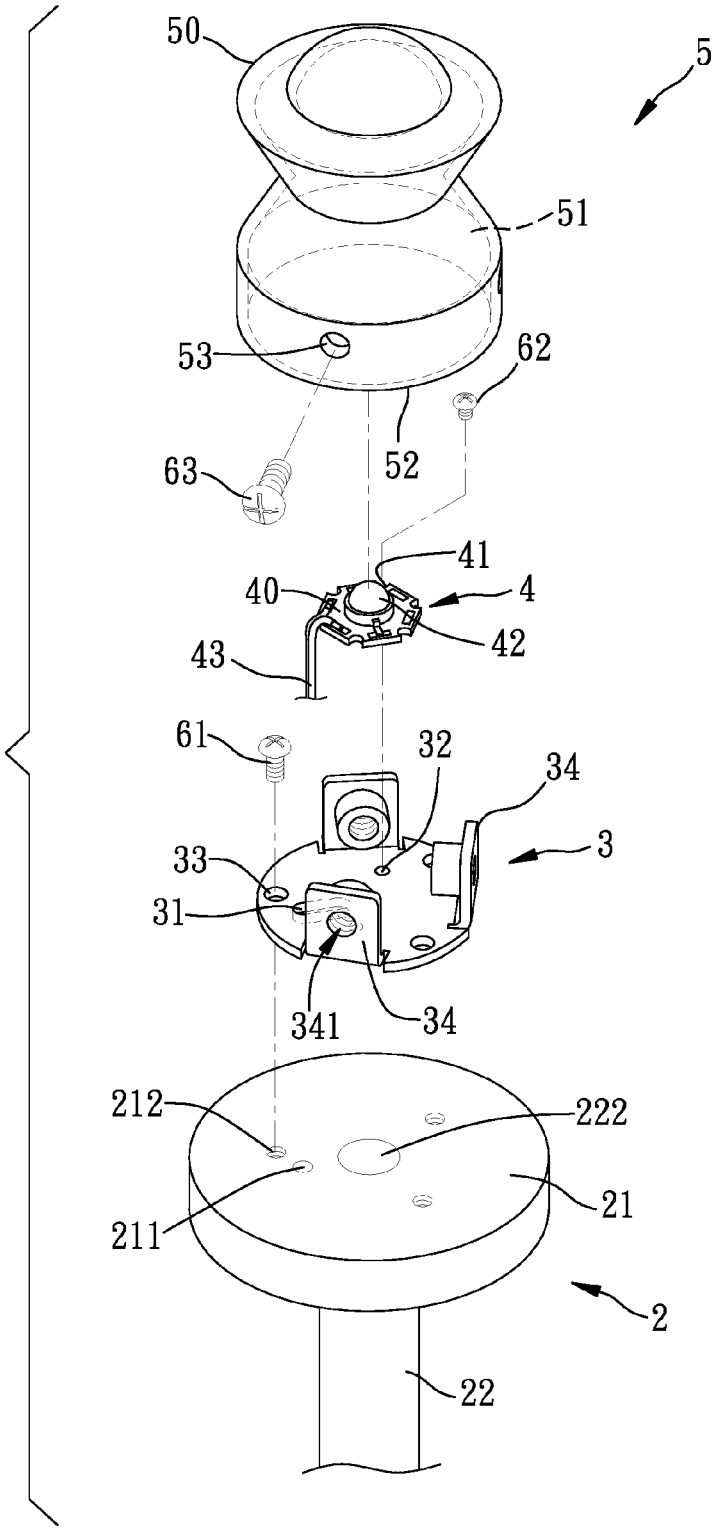
FIG. 2 is an exploded perspective view of a target assembly of the game machine.

As shown in FIG. 2, the target assembly 5 includes, from bottom to top, a supporting rod 2, a retaining base 3, a lighting device 4, a target 50. The rod 2 includes a shank 22 and a flattop head 21 formed theretop. The drive mechanism 12, as shown in FIG. 1, is configured to drive the rod 2 to move up and down. And, when the rod 2 moves up, the target 50 on the rod 2 pops out of the hole 11 in the table 1; and when the rod 2 moves down, the target 50 retracts back into the hole 11.

Specifically, the rod 2 defines three eccentric bores 211 and a screw hole 212 in the head 21. The retaining base 3, on the other hand, defines an aperture 31 in a radial direction. The retaining base 3 further defines a hole 33 aligned with the screw hole 212 in the rod 2 such that the retaining base 3 can be secured onto the head 21 of the rod 2 by means of a first screw 61, where the aperture 31 in the retaining base 3 is in communication with the associated eccentric bore 211 in the rod 2.

Figure 3:
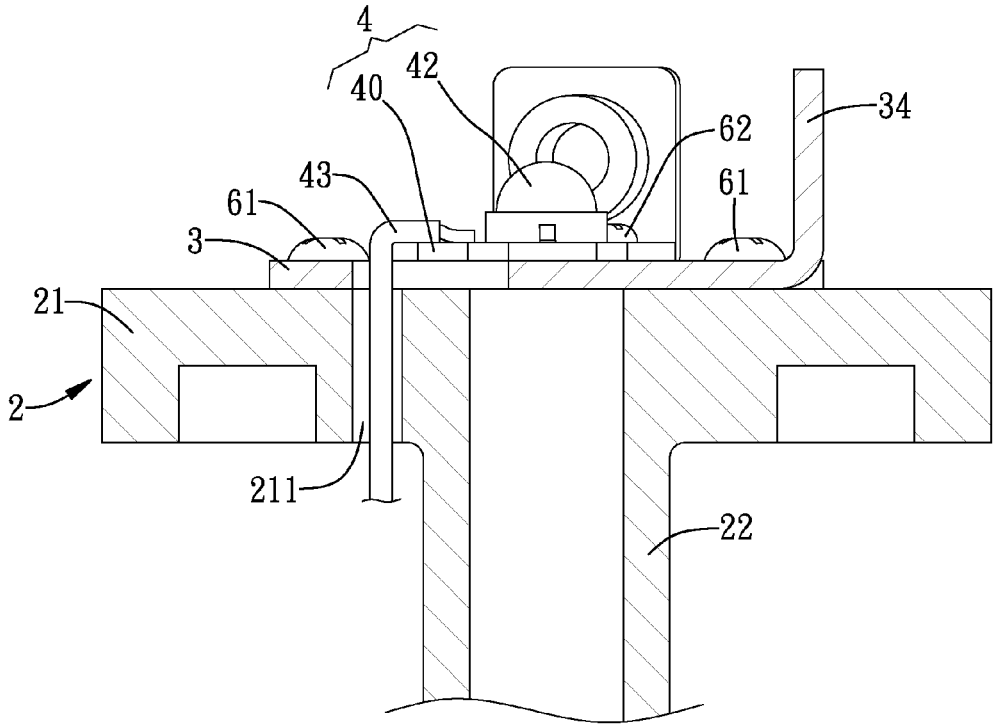
FIG. 3 is a fragmentary sectional view of the assembly in FIG. 2.

The lighting device 3 is disposed on the retaining base 3 and includes a light source having a substrate 40 and a light emitting diode package 42 mounted on the substrate 40, and an electric wire 43 extending from the light source. In addition, notches 41 are defined in a peripheral of the substrate 40 of the light source so that a second screw 62 can be screwed through the associated notch 41 as well as a hole 32 defined in the retaining base 3 for mechanical connection of the lighting device 3 and the retaining base 3. The electric wire 43 extends from a side of the substrate 40 of the light source and through both of the aperture 31 in the retaining base 3 and the eccentric bore 211 in the head 21 of the rod 2, as depicted in FIG. 3.

The target 50 is made of a light-transmissive material and disposed on the head 21 of the rod 2. The target 50 has a receptacle 51 so that the retaining base 3 together with the lighting device 3 may be housed in the receptacle 51. In such a fashion, the target 50 may be lighted by the lighting device 3 to create fancy visual effects. Moreover, the target 50 defines at least one positioning hole 53 in a cylindrical wall of the receptacle 51. On the other hand, the retaining base 3 has at least one upright wall 34 adjacent to the cylindrical wall of the receptacle 53 and a screw hole 341 defined in the upright wall 34 and corresponding to the positioning hole 53 in the cylindrical wall of the receptacle 51. In this way, a third screw 63 can be laterally screwed through the positioning hole 53 of the receptacle 51 and the screw hole 341 in the upright wall 34 for mechanical connection of the target 50 and the retaining base 3.

Figure 4:
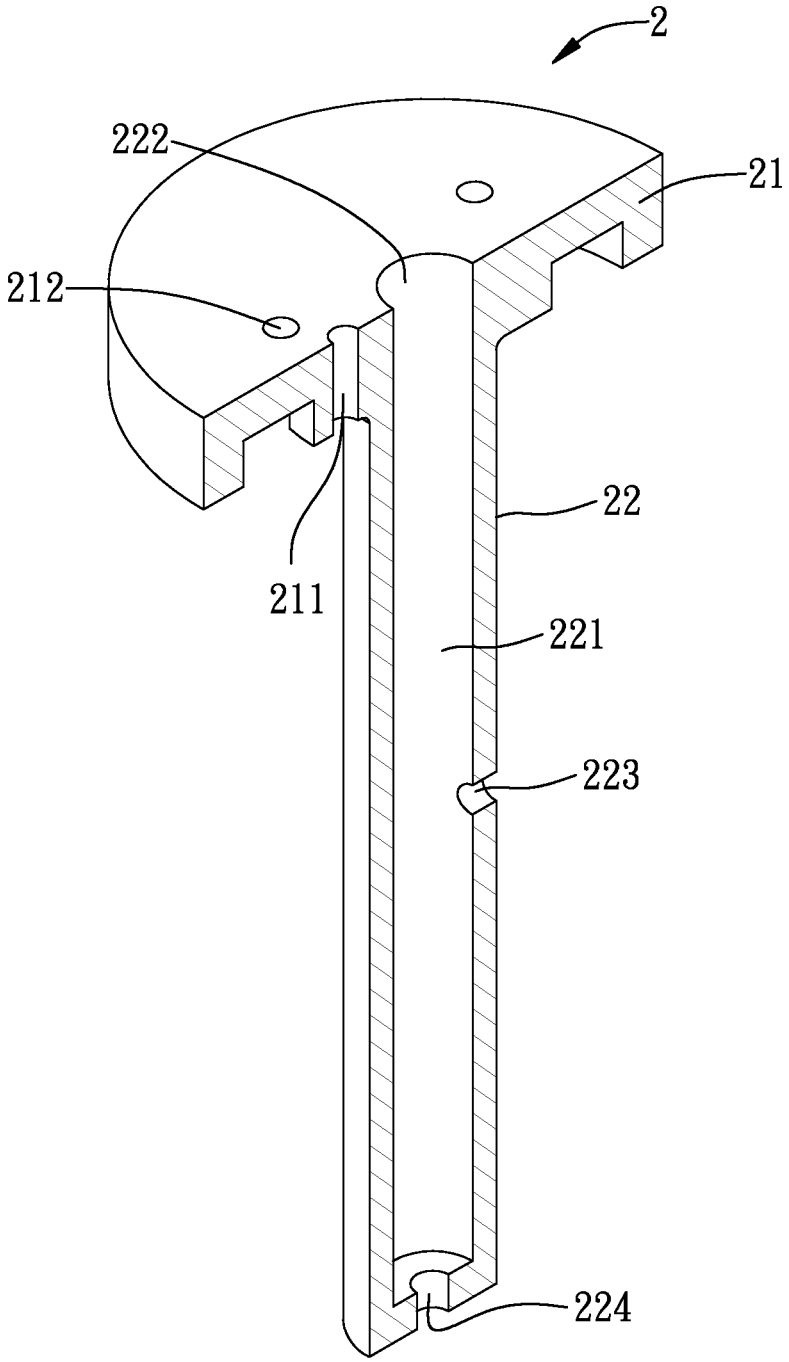
FIG. 4 is an isometric view of a supporting rod of the target assembly of FIG. 2, partly broken away to show internal detail.
Figure 5:
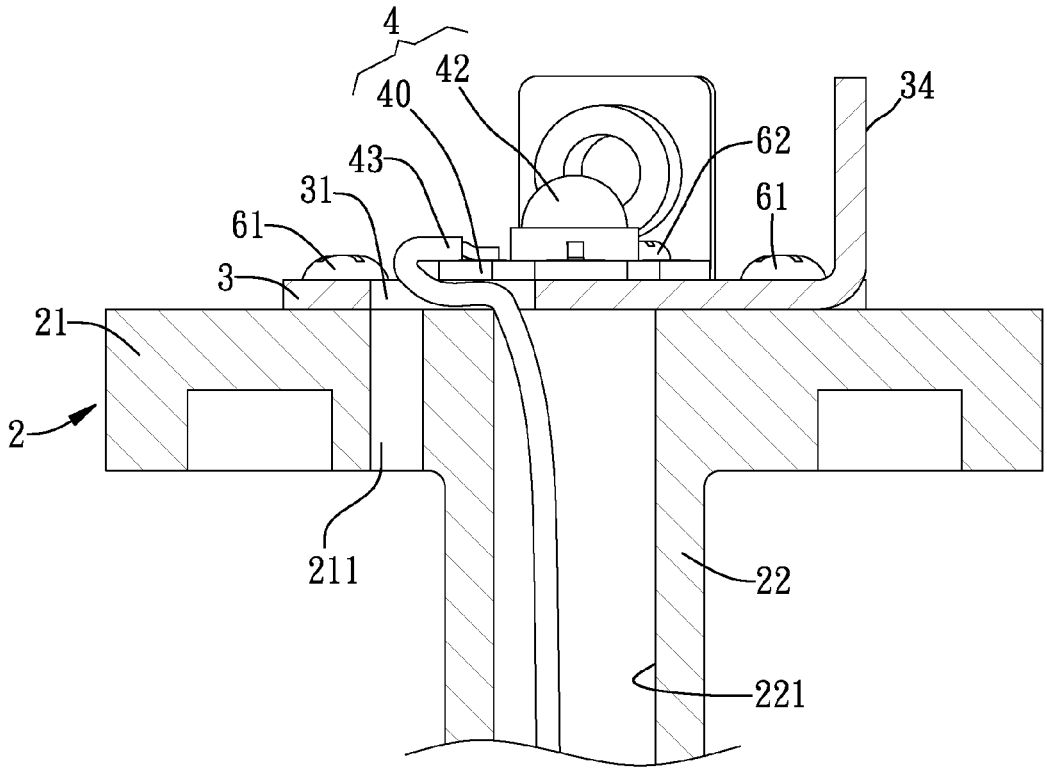
FIG. 5 is a view similar to that of FIG. 3 but with the electric wire arranged in another manner.
Figure 6:
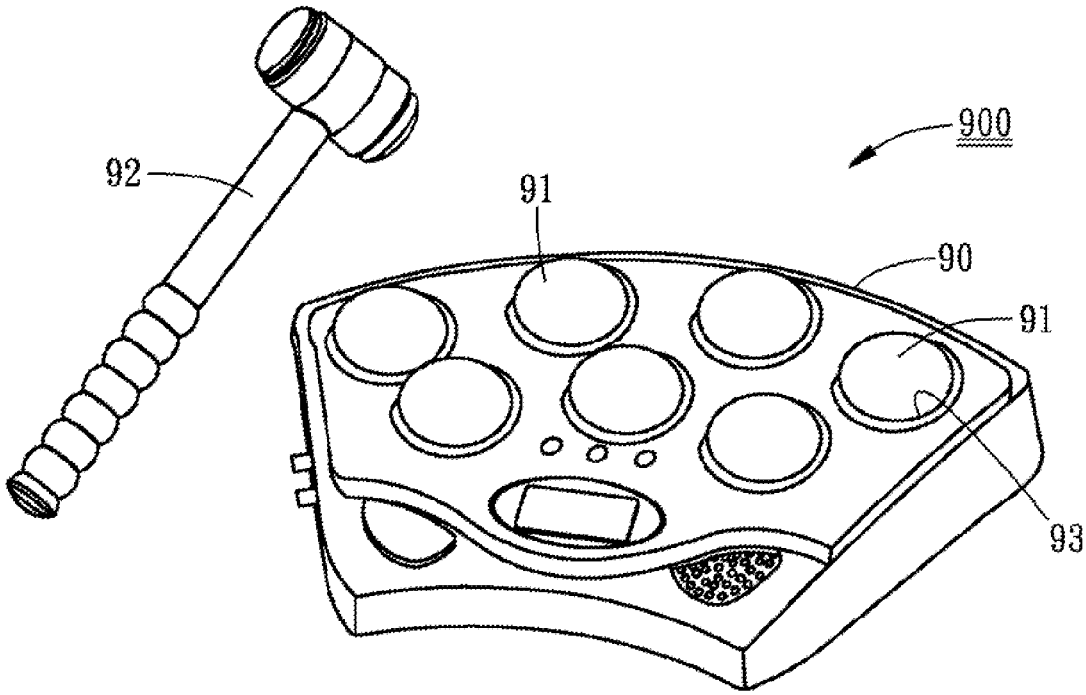
FIG. 6 PRIOR ART
FIG. 6 is a prior art.

Referring to FIG. 4, the supporting rod 2 has not only the eccentric bore 211 for the electric wire 43 but also an axial bore 221 extending through a central axis of the rod 2. The axial bore 211 includes a first opening 222 in a top surface of the head 21 and a second opening 224 in a bottom surface of the shank 22. Moreover, a third opening 223 is defined in a side wall of the shank 22 and in communication with the axial bore 221 in the rod 2. In particular, both of the eccentric bore 211 and the axial bore 221 in the rod 2 are in communication with the radial aperture 31 in the retaining base 3, as shown in FIG. 3 or 5, so that the electric wire 43 of the lighting device 4 may therefore be selectively passed either through the eccentric bore 211 after the aperture 31, as depicted in FIG. 3, or through the axial bore 221 after the aperture 31, as depicted in FIG. 5. If the electric wire 43 is passed into the axial bore 221, the electric wire 43 may further be selectively passed through either the bottom opening 224 or the side opening 223 in the shank 22.

It is to be understood that the disclosed embodiments are illustrative in nature and the invention is not to be limited to any one or more embodiments except as set forth in the following claims.

What is claimed is:

1. A game machine comprising:

a cabinet having a table in which at least one hole is defined;

a supporting rod disposed in the cabinet, formed on top with a flattop head, and defining a first bore therein;

a retaining base secured on the head of the rod, and defining an aperture in communication with the first bore in the rod;

a lighting device having a light source and an electric wire extending from the light source; the light source being seated on the retaining base; and the electric wire extending through both of the aperture in the retaining base and the first bore in the rod;

at least one target made of a light-transmissive material and disposed on the head of the rod; the target further having a receptacle such that the retaining base together with the lighting device is housed in the receptacle; and a drive mechanism disposed in the cabinet, and configured to drive the rod to move up and down;

wherein when the rod moves up, the target on the rod pops out of the hole in the table of the cabinet; and when the rod moves down, the target retracts back into the hole.

2. The game machine of claim 1, wherein the target defines at least one positioning hole in a wall of the receptacle; the retaining base has at least one upright wall adjacent to the wall of the receptacle and a screw hole defined in the upright wall and corresponding to the positioning hole in the wall of the receptacle.

3. The game machine of claim 1, wherein the first bore in the rod is an eccentric bore.

4. The game machine of claim 1, wherein the first bore in the rod is an axial bore extending through a central axis of the rod.

5. The game machine of claim 1, wherein the first bore in the rod is an eccentric bore; the rod further defines a second axial bore extending through a central axis of the rod; and the aperture of the retaining base extends in a radial direction and in communication with the first eccentric bore and the second axial bore of the rod.

6. The game machine of claim 5, wherein the rod has a side opening defined in a wall of the second axial bore.

7. A target assembly for a game machine, comprising:

a supporting rod formed on top with a flattop head, being movable up and down, and defining a first bore therein;

a retaining base secured on the head of the rod, and defining an aperture in communication with the first bore in the rod;

a lighting device having a light source and an electric wire extending from the light source; the light source being seated on the retaining base; and the electric wire extending through both of the aperture in the retaining base and the first bore in the rod;

a target made of a light-transmissive material and disposed on the head of the rod; the target having a receptacle such that the retaining base together with the lighting device is housed in the receptacle; and wherein the target is constructed to pop out of a hole in a table of the game machine as the rod moves up and retract back into the hole as the rod moves down.

8. The target assembly of claim 7, wherein the target defines at least one positioning hole in a wall of the receptacle; the retaining base has at least one upright wall adjacent to the wall of the receptacle and a screw hole defined in the upright wall and corresponding to the positioning hole in the wall of the receptacle.

9. The target assembly of claim 7, wherein the first bore in the rod is an eccentric bore.

10. The target assembly of claim 7, wherein the first bore in the rod is an axial bore extending through a central axis of the rod.

11. The target assembly of claim 7, wherein the first bore in the rod is an eccentric bore; the rod further defines a second axial bore extending through a central axis of the rod; and the aperture of the retaining base extends in a radial direction and in communication with the first eccentric bore and the second axial bore of the rod.

12. The target assembly of claim 11, wherein the rod has a side opening defined in a wall of the second axial bore.

* * * * *